US008357346B2

(12) United States Patent
Kim et al.

(10) Patent No.: US 8,357,346 B2
(45) Date of Patent: Jan. 22, 2013

(54) ENHANCED CARBON NANOTUBE WIRE

(75) Inventors: Yong Hyup Kim, Seoul (KR); Eui Yun Jang, Seoul (KR)

(73) Assignee: SNU R&DB Foundation, Seoul (KR)

( * ) Notice: Subject to any disclaimer, the term of this patent is extended or adjusted under 35 U.S.C. 154(b) by 0 days.

(21) Appl. No.: 12/195,347

(22) Filed: Aug. 20, 2008

(65) Prior Publication Data

US 2010/0047568 A1 Feb. 25, 2010

(51) Int. Cl.
*D02G 3/00* (2006.01)
*B05D 1/36* (2006.01)

(52) U.S. Cl. ..... 423/447.2; 428/367; 427/409; 205/78

(58) Field of Classification Search ..... 205/78; 423/447.2
See application file for complete search history.

(56) References Cited

U.S. PATENT DOCUMENTS

| | | | |
|---|---|---|---|
| 4,841,786 | A | 6/1989 | Schulz |
| 5,763,879 | A | 6/1998 | Zimmer et al. |
| 5,948,360 | A | 9/1999 | Rao et al. |
| 6,781,166 | B2 | 8/2004 | Lieber et al. |
| 6,905,667 | B1 | 6/2005 | Chen et al. |
| 7,054,064 | B2 | 5/2006 | Jiang et al. |
| 7,147,894 | B2 | 12/2006 | Zhou et al. |
| 7,164,209 | B1 | 1/2007 | Duan et al. |
| 7,288,317 | B2 | 10/2007 | Poulin et al. |
| 7,385,295 | B2 | 6/2008 | Son et al. |
| 2002/0014667 | A1 | 2/2002 | Shin et al. |
| 2002/0069505 | A1 | 6/2002 | Nakayama et al. |
| 2002/0127162 | A1 | 9/2002 | Smalley et al. |
| 2003/0122111 | A1 | 7/2003 | Glatkowski |
| 2003/0161950 | A1 | 8/2003 | Ajayan et al. |
| 2004/0053780 | A1 | 3/2004 | Jiang et al. |
| 2004/0173378 | A1 | 9/2004 | Zhou et al. |
| 2004/0265550 | A1 | 12/2004 | Glatkowski et al. |
| 2006/0060825 | A1 | 3/2006 | Glatkowski |
| 2006/0099135 | A1 | 5/2006 | Yodh et al. |
| 2006/0113510 | A1 | 6/2006 | Luo et al. |
| 2006/0133982 | A1 | 6/2006 | Kinloch et al. |
| 2006/0274048 | A1 | 12/2006 | Spath et al. |
| 2007/0007142 | A1* | 1/2007 | Zhou et al. ..... 205/78 |
| 2007/0014148 | A1 | 1/2007 | Zhou et al. |
| 2007/0020458 | A1 | 1/2007 | Su et al. |
| 2007/0045119 | A1 | 3/2007 | Sandhu |

(Continued)

FOREIGN PATENT DOCUMENTS

| | | | |
|---|---|---|---|
| CN | 1849181 | A | 10/2006 |
| DE | 69728410 | T2 | 12/1998 |

(Continued)

OTHER PUBLICATIONS

Jiang et al., "Spinning continuous carbon nanotube yarns", Nature, vol. 419, 801 (2002).

(Continued)

*Primary Examiner* — Emily Le
*Assistant Examiner* — Rebecca Lee
(74) *Attorney, Agent, or Firm* — Knobbe, Martens, Olson & Bear, LLP

(57) ABSTRACT

Techniques for manufacturing an enhanced carbon nanotube (CNT) wire are provided. In one embodiment, an enhanced CNT wire may be manufactured by immersing a metal tip into a CNT colloidal solution, withdrawing the metal tip from the CNT colloidal solution, and then coating the CNT wire with a polymer.

19 Claims, 8 Drawing Sheets

U.S. PATENT DOCUMENTS

| | | | | |
|---|---|---|---|---|
| 2007/0243124 | A1 | 10/2007 | Baughman et al. | |
| 2007/0248528 | A1 | 10/2007 | Kim | |
| 2008/0000773 | A1 | 1/2008 | Lee et al. | |
| 2008/0044651 | A1 | 2/2008 | Douglas | |
| 2008/0044775 | A1 | 2/2008 | Hong et al. | |
| 2008/0048996 | A1 | 2/2008 | Hu et al. | |
| 2008/0088219 | A1 | 4/2008 | Yoon et al. | |
| 2008/0171193 | A1 | 7/2008 | Yi et al. | |
| 2008/0290020 | A1* | 11/2008 | Marand et al. | 210/500.27 |
| 2009/0059535 | A1 | 3/2009 | Kim et al. | |
| 2010/0040529 | A1 | 2/2010 | Kim et al. | |
| 2010/0140097 | A1 | 6/2010 | Wei et al. | |

FOREIGN PATENT DOCUMENTS

| | | | |
|---|---|---|---|
| JP | 2002301700 | A | 10/2002 |
| JP | 2005061859 | A | 3/2005 |
| JP | 2005255985 | A | 9/2005 |
| JP | 2006513048 | A | 4/2006 |
| JP | 3868914 | B2 | 1/2007 |
| JP | 2008103329 | A | 5/2008 |
| JP | 2008177165 | A | 7/2008 |
| KR | 20070072222 | A | 7/2007 |
| KR | 1020070112733 | | 11/2007 |
| KR | 1020080063194 | A | 7/2008 |
| KR | 101085276 | B1 | 11/2011 |

OTHER PUBLICATIONS

Li et al., "Direct Spinning of carbon Nanotube Fibers from Chemical Vapor Deposition Synthesis", Science, vol. 304, 276-278 (2004).
Zhang et al., "Multifunctional Carbon Nanotube Yarns by Downsizing an Ancient Technology", Science, vol. 306, 1358-1361 (2004).
Goldstein et al., "Zero TCR Foil Resistor Ten Fold Improvement in Temperature Coefficient", Electronic Components and Tech. Conf., IEEE, 2001.
Hulman et al., The dielectrophoretic attachment of nanotube fibres on tungsten needles, Mar. 6, 2007, Nanotechnology, 18, 1-5.
Im, et al., "Directed-assembly of Single-walled Carbon Nanotubes Using Self-assembled Monolayer Patterns Comprising Conjugated Molecular Wires," *Nanotechnology*, (2006) vol. 17: pp. 3569-3573.
International Search Report dated Mar. 5, 2009 for corresponding PCT Application No. PCT/KR2008/007144 filed Dec. 3, 2008.
International Written Opinion dated Mar. 5, 2009 for corresponding PCT Application No. PCT/KR2008/007144 filed Dec. 3, 2008.
Kaempgen et al., "Transparent carbon nanotube coatings," Applied Surface Science 252; pp. 425-429 (2005).
Kang et al., "Sandwich-Type Laminated Nanocomposites Developed by Selective Dip-Coating of Carbon Nanotubes", Adv. Mater., 19, 427-432 (2007).
Ko et al., "Electrospinning of Continuous Carbon Nanotube-Filled Nanofiber Yarns", Adv. Mater., 15, No. 14, pp. 1161-1165 (2003).
Kumar et al., "Search for a novel zero thermal expansion material: dilatometry of the Agl-Cul system", J. Mater Sci. 41, pp. 3861-3865 (2006).
Kwon et al., "Thermal Contraction of Carbon Fullerenes and Nanotubes", Phy. Rev. Lett., vol. 92, No. 1, pp. 015901-015904 (2004).
Kwon, "Computational Modeling and Applications of Carbon Nanotube Devices", NSI Workshop Series-IV, Jul. 11, 2007.
Lee et al., "Linker-free directed assembly of high-performance integrated devices based on nanotubes and nanowires", Nature Nanotechnology, vol. 1, pp. 66-71, Oct. 2006.
Lewenstein, et al., "High-yield Selective Placement of Carbon Nanotubes on Pre-patterned Electrodes," *NanoLetters*, (2002) vol. 2, Issue (5): pp. 443-446.
Liu et al., "Controlled deposition of individual single-walled carbon nanotubes on chemically functonalize templates," Chemical Physicas Letters, Apr. 2, 1999, 303, 125-129.
Liu et al., "Controlled Growth of Super-Aligned Carbon Nanotube Arrays for Spinning Continuous Unidirectional Sheets with Tunable Physical Properties", Nano Letters, vol. 8, No. 2, pp. 700-705 (2008).
Ma et al., "Directly Synthesized Strong, Highly Conducting, Transparent Single-Walled Carbon Nanotube Films", Nano Letters, vol. 7, No. 8, pp. 2307-2311 (2007).
Nakagawa, et al., "Controlled Deposition of Silicon Nanowires on Chemically Patterned Substrate by Capillary Force Using a Blade-coating Method," *J. Phys. Chem.*, (2008) vol. 112: pp. 5390-5396.
Rao et al., "Large-scale assembly of carbon nanotubes", Nature, vol. 425, pp. 36-37, Sep. 4, 2003.
Tang, et al., "Assembly of 1D Nanostructures into Sub-micrometer Diameter Fibrils with Controlled and Variable Length by Dielectrophoresis," *Adv. Mater.*, 15, No. 16, pp. 1352-1355, 2003.
Wang et al., "Controlling the shape, orientation, and linkage of carbon nanotube features with nano affinity templates", PNAS, vol. 103, No. 7, pp. 2026-2031 (2006).
Annamalai, et al., "Electrophoretic drawing of continuous fibers of single-walled carbon nanotubes," *J. AppL Phys.*, 98 114307-1 through 114307-6 (2005).
Kornev, et al., "Ribbon-to-Fiber Transformation in the Process of Spinning of Carbon-Nanotube Dispersion," *Physical Review Letters*, 97, 188303-1 through 188303-4, 2006.
Poulin, et al., "Films and fibers of oriented single wall nanotubes," *Carbon*, 40 (2002) pp. 1741-1749.
Brioude, et al., "Synthesis of sheathed carbon nanotube tips by the sol-gel technique," *Applied Surface Science*, 221, 2004, pp. 4-9.
Dong, et al., "Synthesis, assembly and device of 1-dimentional nanostructures," *Chinese Science Bulletin*, 47(14), 2002, pp. 1149-1157.
Office Action dated Jun. 30, 2009 from U.S. Appl. No. 12/192,024, filed Aug. 14, 2008.
Office Action dated Oct. 19, 2009 from U.S. Appl. No. 12/192,024, filed Aug. 14, 2008.
Office Action dated May 7, 2010 from U.S. Appl. No. 12/192,024, filed Aug. 14, 2008.
Office Action dated Aug. 24, 2010 from U.S. Appl. No. 12/192,024, filed Aug. 14, 2008.
Office Action dated Jan. 6, 2011 from U.S. Appl. No. 12/192,024, filed Aug. 14, 2008.
Office Action dated Mar. 24, 2009 from U.S. Appl. No. 12/198,815, filed Aug. 26, 2008.
Office Action dated Oct. 28, 2009 from U.S. Appl. No. 12/198,815, filed Aug. 26, 2008.
Office Action dated May 17, 2010 from U.S. Appl. No. 12/198,815, filed Aug. 26, 2008.
Office Action dated Dec. 8, 2010 from U.S. Appl. No. 12/198,815, filed Aug. 26, 2008.
Office Action dated Jul. 20, 2009 from U.S. Appl. No. 12/198,835, filed Aug. 26, 2008.
Office Action dated Feb. 2, 2010 from U.S. Appl. No. 12/198,835, filed Aug. 26, 2008.
Office Action dated Jun. 18, 2010 from U.S. Appl. No. 12/198,835, filed Aug. 26, 2008.
Office Action dated Oct. 4, 2010 from U.S. Appl. No. 12/198,835, filed Aug. 26, 2008.
Office Action dated Mar. 3, 2011, from U.S. Appl. No. 12/192,024, filed on Aug. 14, 2008.
Decision to Grant a Patent, mailing date May 24, 2011, in Japanese Patent Appln. No. 2008-310451.
Office Action dated May 26, 2011, from U.S. Appl. No. 12/233,339, filed on Sep. 18, 2008.
Song, et al., "Fabrication of Carbon Nanotube Field Emitters Using a Dip-Coating Method," *Chem. Vap. Deposition*, 12, pp. 375-379, 2006.
Arnold, M.S., et al., "Sorting carbon nanotubes by electronic structure using density differentiation", Nature Nanotechnology, vol. 1, pp. 60-65 (2006).
Carroll, D.L., et al., "Polymer—nanotube composites for transparent, conducting thin films," Synthetic Metals, vol. 155, Issue 3, pp. 694-697 (2005).
Meng et al., "The Synthesis of MWNTs/SWNTs Multiple Phase Nanowire Arrays in Porous Anodic Aluminum Oxide Templates," Materials Science and Engineering: A, vol. 354, Issue 1-2, pp. 92-96 (2003).
Valentini, L., and Kenny, J.M., "Novel approaches to developing carbon nanotube based polymer composites: fundamental studies and nanotech applications," Polymer, vol. 46, Issue 17, pp. 6715-6718 (2005).
Yong II Song et al., "Fabrication of Carbon Nanotube Field Emitters Using a Dip-Coating Method," Chemical Vapor Deposition, vol. 12, pp. 375-379 (2006).

* cited by examiner

ENHANCED CARBON NANOTUBE WIRE

TECHNICAL FIELD

The described technology relates generally to Carbon Nanotube (CNT) structures and, more particularly, to CNT wires coated with a polymer.

BACKGROUND

Recently, Carbon Nanotube (CNT) technology has attracted great interest because of its fundamental properties and future applications. Some of the interesting features of CNTs are their electronic, mechanical, optical and chemical characteristics, which make them potentially useful in many applications. As a result of their useful characteristics, CNTs are presently being used to manufacture CNT articles such as CNT wires, fibers, and strands.

However, at present, CNT wires are weak mechanically and, as a result, are fragile and easily breakable, for example, by an external mechanical force. This is because the CNTs that form a CNT wire adhere to each other by a relatively weak van der Waals force. As such, there is a need to enhance the mechanical strength of the CNT wire to overcome this deficiency. Further, increases in temperature may cause the electrical resistance of the CNT wire to increase. Therefore, there is a need to develop an enhanced CNT wire that limits such rise in electrical resistance.

SUMMARY

Techniques for manufacturing an enhanced CNT wire are provided. In one embodiment, by way of non-limiting example, a method for manufacturing an enhanced CNT wire comprises providing a metal tip and a CNT colloidal solution, immersing the metal tip into the CNT colloidal solution, withdrawing the metal tip from the CNT colloidal solution to form a CNT wire, and coating at least a portion of the CNT wire with a polymer.

In another embodiment, a processor-readable storage medium storing instructions that, when executed by a processor, causes the processor to control an apparatus to perform a method comprising immersing a metal tip at least partially into a CNT colloidal solution, withdrawing the metal tip from the CNT colloidal solution to form a CNT wire, and coating at least a part of the CNT wire with a polymer.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

DETAILED DESCRIPTION

Figure 1:
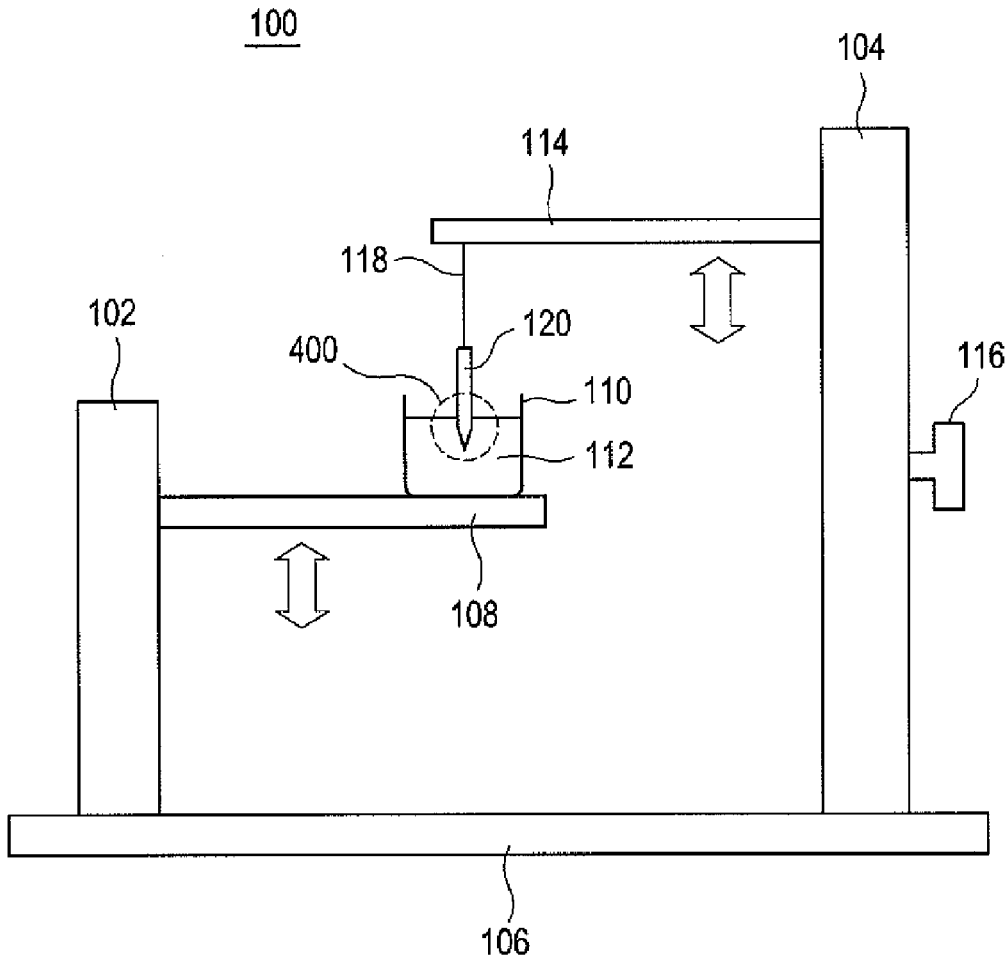
FIG. 1 is a schematic view of an illustrative embodiment of a CNT wire manufacturing system.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and make part of this disclosure.

This disclosure is drawn, inter alia, to methods, apparatuses, processor-readable storage media stored instructions, and systems related to CNTs.

FIG. 1 is a schematic view of an illustrative embodiment of a CNT wire manufacturing system 100. As depicted, system 100 comprises a left guider 102 and a right guider 104, each mounted on a base 106. A stage 108 may be attached to left guider 102 and configured to substantially vertically move along left guider 102 by operation of a motor (not shown). A vessel 110 may be placed on stage 108 to contain a CNT colloidal solution 112 therein. Vessel 110 may be made from a hydrophobic material such as fluorinated ethylene propylene (sold under the trademark Teflon), other PTFE (polytetrafluoroethylene) substances, etc. A hanger 114 may be mounted to right guider 104 such that hanger 114 can move substantially vertically along right guider 104 by the operation of a manipulator 116. Hanger 114 may suspend a metal tip 120 through a holder 118, so that metal tip 120 may move substantially vertically upward or downward in accordance with the movement of hanger 114. Stage 108 and hanger 114 may be configured to move in a mutually cooperative relationship, thereby arranging metal tip 120 to be at least partially immersed into CNT colloidal solution 112. The above operations of system 100 may be automated without any intervention from an operator. By way of example, in one embodiment, the operations may be controlled by a processor in system 100 configured to execute appropriate instructions, and a motor may be employed to drive the stage 108, hanger 114, or both.

In one embodiment, CNT colloidal solution 112 may include CNT colloids dispersed in a solvent. Concentration of the CNT colloids in CNT colloidal solution 112 may be, by way of example and not a limitation, from about 0.05 mg/ml to about 0.2 mg/ml. CNT colloidal solution 112 may be prepared by first purifying CNTs, and then dispersing the purified CNTs in a solvent. The purification may be performed by wet oxidation in an acid solution or by dry oxidation. The solvent may be D.I. (De-Ionized) water, an organic solvent such as dimethylformamide (DMF), Dimethyl sulfoxide (DMSO), Tetrahydrofuran (THF), etc. The CNT may include single-walled nanotubes (SWNTs) or multi-walled nanotubes (MWNTs). Since nanotubes produced by conventional processes may contain impurities, nanotubes may be purified before being formed into the colloidal solution. Alternatively, purified CNTs may be purchased directly and employed in place of such unpurified nanotubes to eliminate the need for such purification. A suitable purification method may comprise refluxing the nanotubes in nitric acid (e.g., about 2.5 M) and re-suspending the nanotubes in pH 10 water with a surfactant (e.g., sodium lauryl sulfate), and then filtering the nanotubes with a cross-flow filtration system. The resulting purified nanotube suspension can then be passed through a filter (e.g., polytetrafluoroethylene filter).

The purified CNTs may be in powder form that can be dispersed into the solvent. Any of a variety of dispersion techniques to affect the concentration of CNT particles may be used, including without limitation, stirring, mixing and the like. In some embodiments, an ultrasonication treatment can be applied to facilitate dispersion of the purified CNTs throughout the solvent. The concentration of the CNT in CNT colloidal solution 112 may be about 0.05 mg/ml. However, the concentration may vary according to the desired specification of the CNT wire such as diameter, length and the like, such that higher concentrations of CNT colloidal solution 112 will yield a CNT wire having a thicker diameter.

Figure 2:
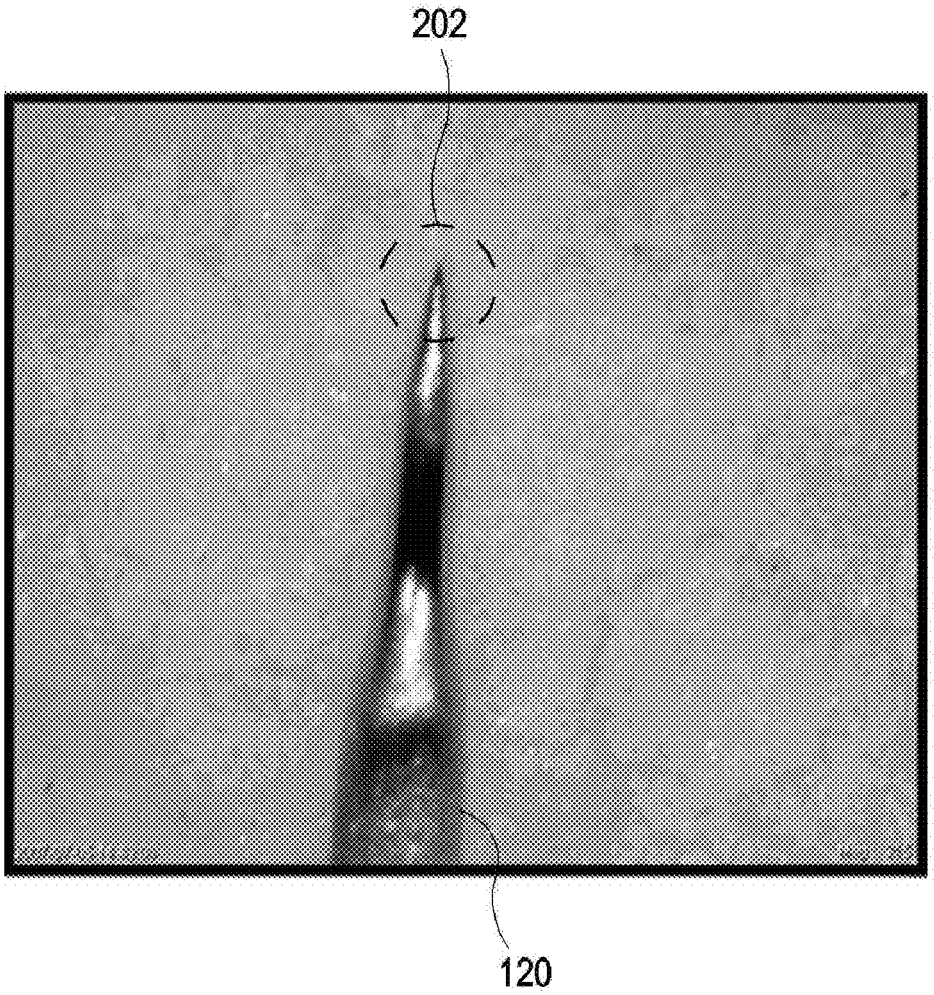
FIG. 2 shows an illustrative embodiment of an etched metal tip.

FIG. 2 shows an illustrative embodiment of metal tip 120, which may have a sharp apex 202 at one end as shown. The sharpness of sharp apex 202 relates to the radius of curvature of sharp apex 202 of metal tip 120 such that the smaller the radius of curvature, the sharper the tip. Depending on the design requirements of metal tip 120, metal tip 120 may have various shapes of sharp apex 202. Sharp apex 202 of the metal tip 120 may have a radius of approximately 250 nm and forms a sharp generally conical shape. The radius of sharp apex 202 may vary from tens of nanometers to hundreds of nanometers. In selecting a material for metal tip 120, a metal that has good wettability with the CNT colloidal solution, such as one or more of tungsten (W), tungsten alloy, platinum, platinum alloy, etc, may be adopted.

Figure 3:
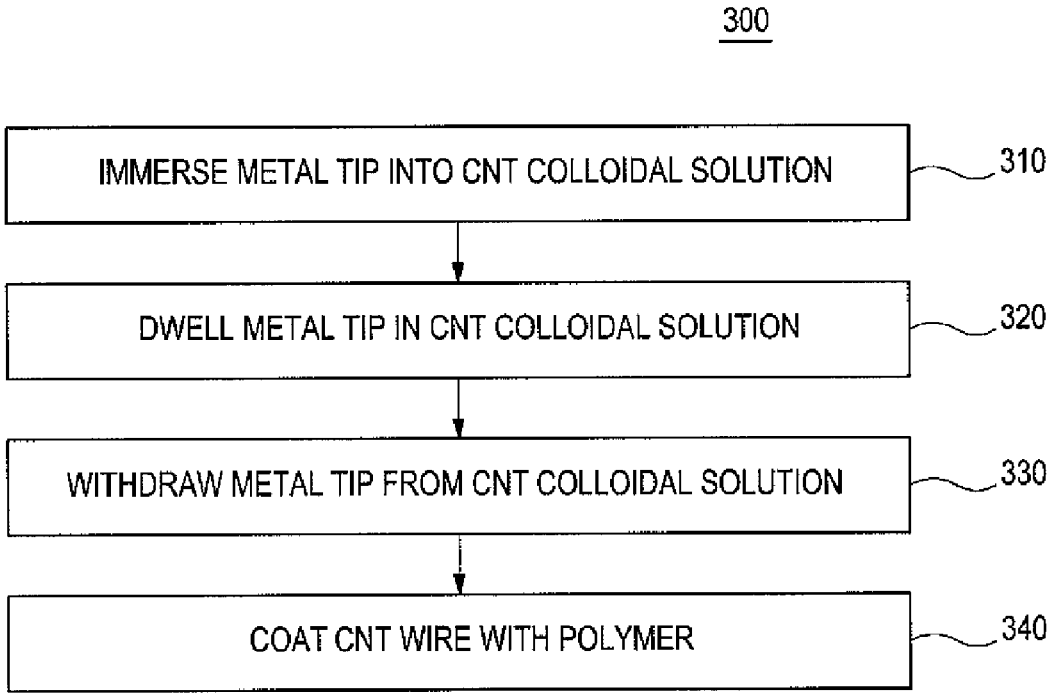
FIG. 3 is a flow chart of an illustrative embodiment of a method for manufacturing an enhanced CNT wire.
Figure 8:
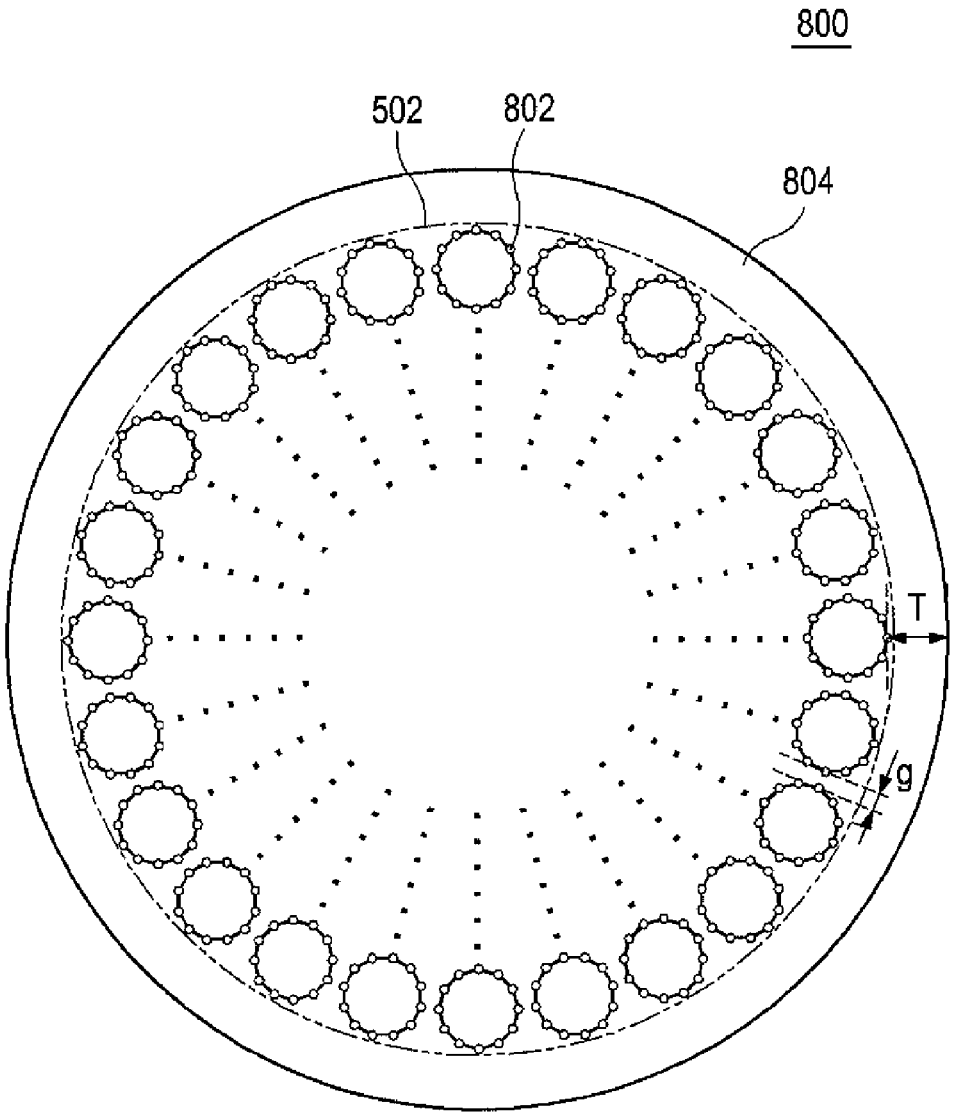
FIG. 8 shows a schematic sectional view of an illustrative embodiment of an enhanced CNT wire coated with a polymer.

FIG. 3 is a flow chart of an illustrative embodiment of a method for manufacturing enhanced CNT wire, for example, enhanced CNT wire 800 (as shown in FIG. 8). Metal tip 120 is at least partially immersed into CNT colloidal solution 112 (FIG. 3, block 310). In some embodiments, as shown in FIG. 1, manipulator 116 operates hanger 114 and holder 118 to allow metal tip 120 to be at least partially immersed into CNT colloidal solution 112 contained in vessel 110. In other embodiments, stage 108 attached to left guider 102 may move substantially vertically upward so that metal tip 120 is at least partially immersed into CNT colloidal solution 112.

Referring again to FIG. 3, immersed metal tip 120 is maintained substantially motionless or dwelled in CNT colloidal solution 112 (FIG. 3, block 320). While dwelling metal tip 120 in CNT colloidal solution 112, CNT colloids in CNT colloidal solution 112 begin to self-assemble toward sharp apex 202 of metal tip 120. The dwelling time may range from several seconds to tens of minutes depending on various environmental factors such as temperature, concentration of CNT colloidal solution 112, sharpness of metal tip 120, etc. In one embodiment, a suitable dwelling time may be between about 2 minutes to about 10 minutes.

Metal tip 120 is at least partially withdrawn from CNT colloidal solution 112, while maintaining the self-assembly of the CNT colloids at sharp apex 202 of metal tip 120 (FIG. 3, block 330). Withdrawing may be performed by substantially vertically lifting metal tip 120 and lowering vessel 110 containing CNT colloidal solution 112, individually or simultaneously. The withdrawing rate may be determined according to the viscosity of CNT colloidal solution 112. As the viscosity of CNT colloidal solution 112 is higher or the target diameter of the CNT wire is smaller, the withdrawing rate of metal tip 120 may become higher. As metal tip 120 is withdrawn further from CNT colloidal solution 112, the withdrawing rate of metal tip 120 may vary, or may otherwise remain constant. In one embodiment, a suitable withdrawing rate may be from about 2 mm/minute to about 5 mm/minute. The withdrawing may be performed at room temperature and/or at atmospheric pressure. As shown in FIG. 1 metal tip 120 can be immersed in CNT colloidal solution 112 and withdrawn without applying a voltage.

Figure 4:
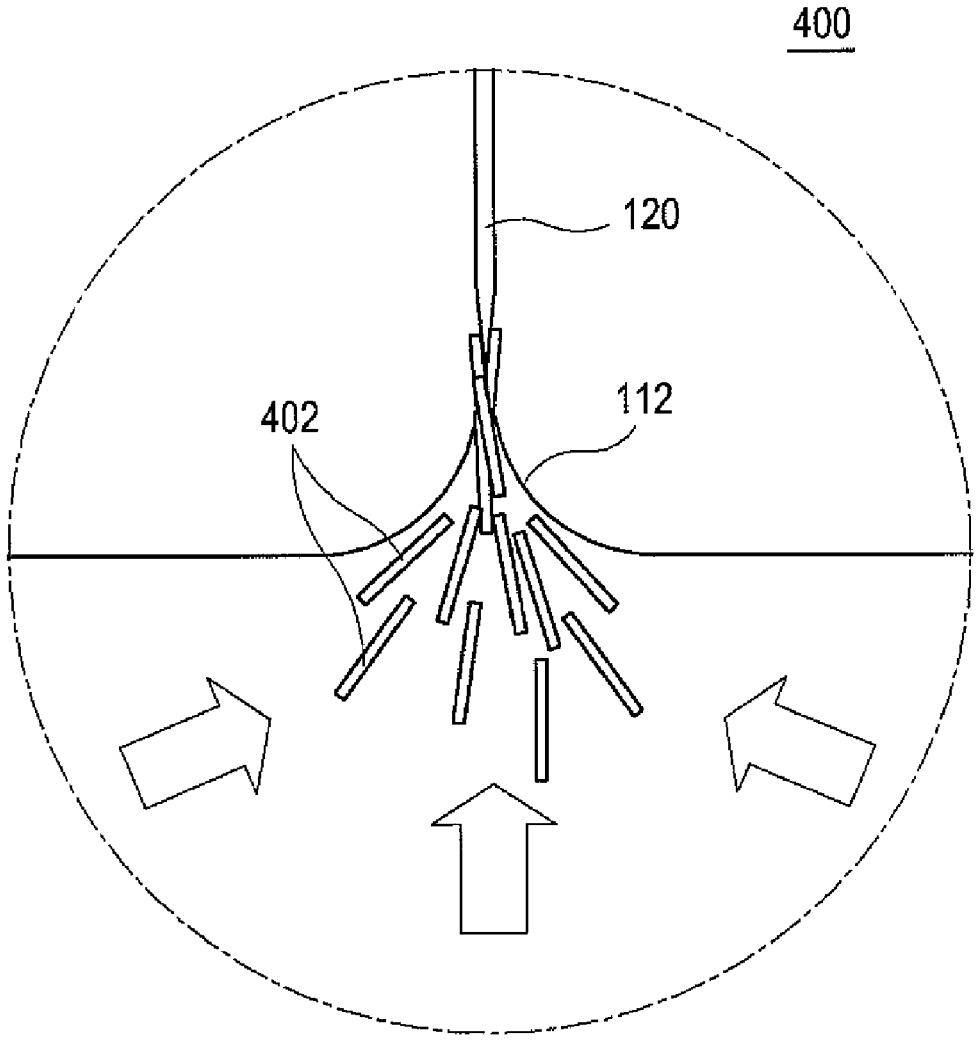
FIG. 4 is a conceptual view of an illustrative embodiment of an interface between a metal tip and a CNT colloidal solution.

FIG. 4 shows a conceptual view of an illustrative embodiment of an interface between metal tip 120 and CNT colloidal solution 112 that is formed when metal tip 120 begins to be at least partially withdrawn from CNT colloidal solution 112. While withdrawing metal tip 120 from CNT colloidal solution 112, CNT colloids 402 in CNT colloidal solution 112 form meniscuses and self-assemble toward sharp apex 202 of metal tip 120. The self-assembly may be understood as the spontaneous and reversible organization of molecular units into ordered structures by non-covalent interactions.

Figure 5:
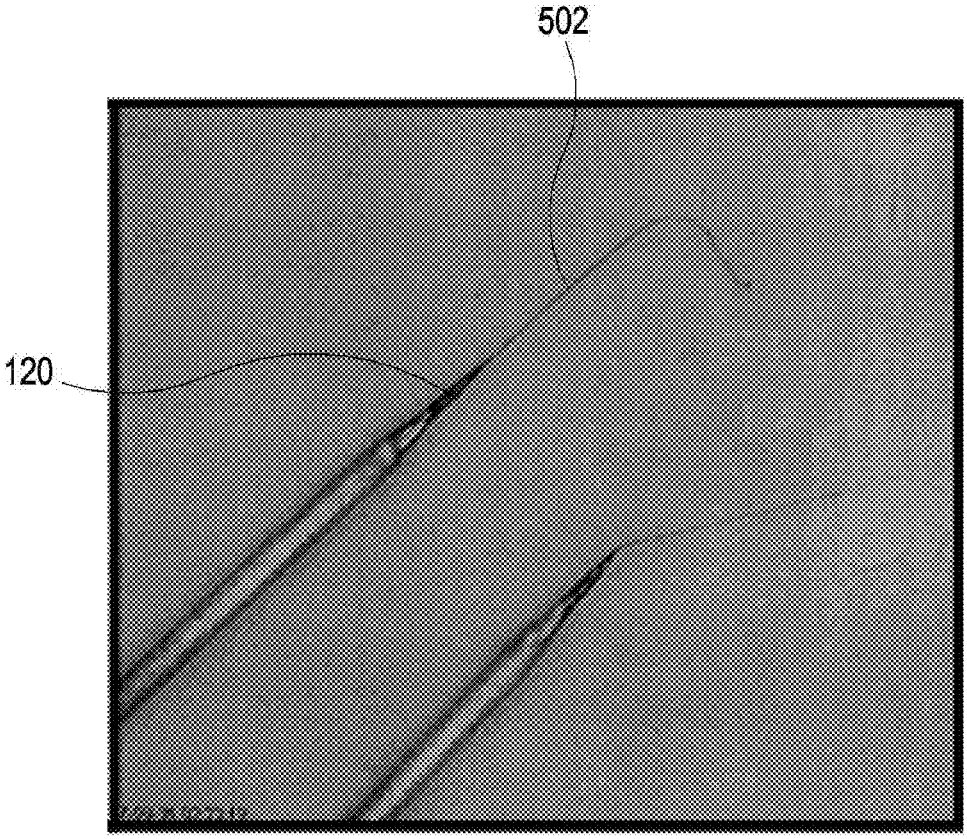
FIG. 5 shows an illustrative embodiment of an image of a CNT wire.

FIG. 5 shows an illustrative embodiment of an image of a CNT wire manufactured from CNT colloidal solution 112. In one illustrative embodiment, the length of CNT wire 502 may be about 10 cm. However, the length of CNT wire 502 may be elongated as needed by expanding the movement of stage 108 or hanger 114, for example, from several centimeters to tens of meters.

Figure 6:
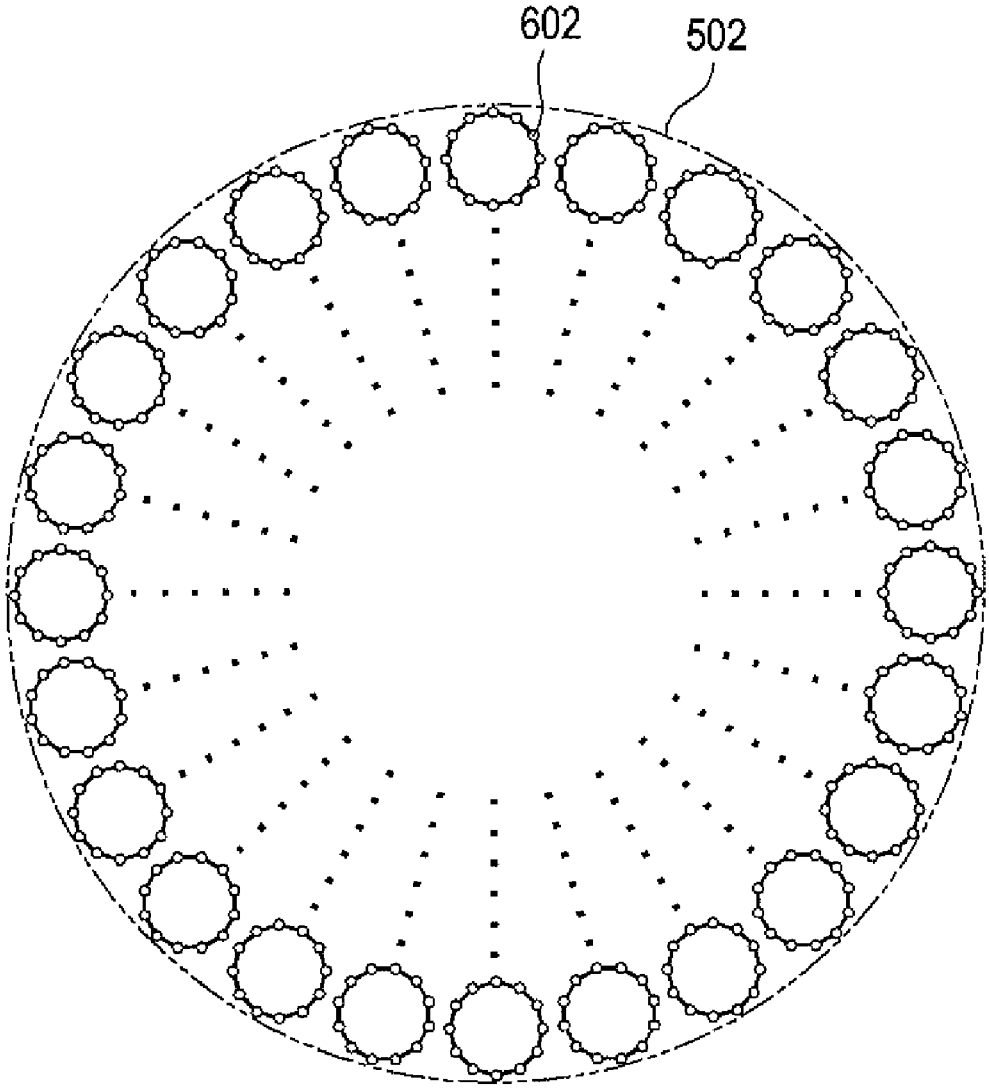
FIG. 6 shows a schematic sectional view of an illustrative embodiment of a CNT wire comprised of single-walled carbon nanotube.

FIG. 6 shows a schematic sectional view of an illustrative embodiment of a CNT wire 502 manufactured from CNT colloidal solution 112 having SWNTs. Alternatively, CNT wire 502 may be manufactured from CNT colloidal solution 112 having MWNTs. As shown in FIG. 6, CNT wire 502 may comprise many, for example, hundreds of millions of SWNTs 602, adhered to neighboring SWNTs 602 by relatively weak Van der Waals force. In one illustrative embodiment, CNT wire 502 may include millions to thousands of millions of SWNTs 602. CNT wire 502 may be reinforced with a durable material such as polydimethylsiloxane (PDMS), polypropylene, polyolefin, polyurethane, etc. to facilitate handling and to prevent breakage by, for example, an applied mechanical force. Although FIG. 6 illustrates CNTs 602 forming CNT wire 502 as being regularly and concentrically arranged, CNTs 602 may be irregularly arranged in CNT wire 502.

Figure 7:
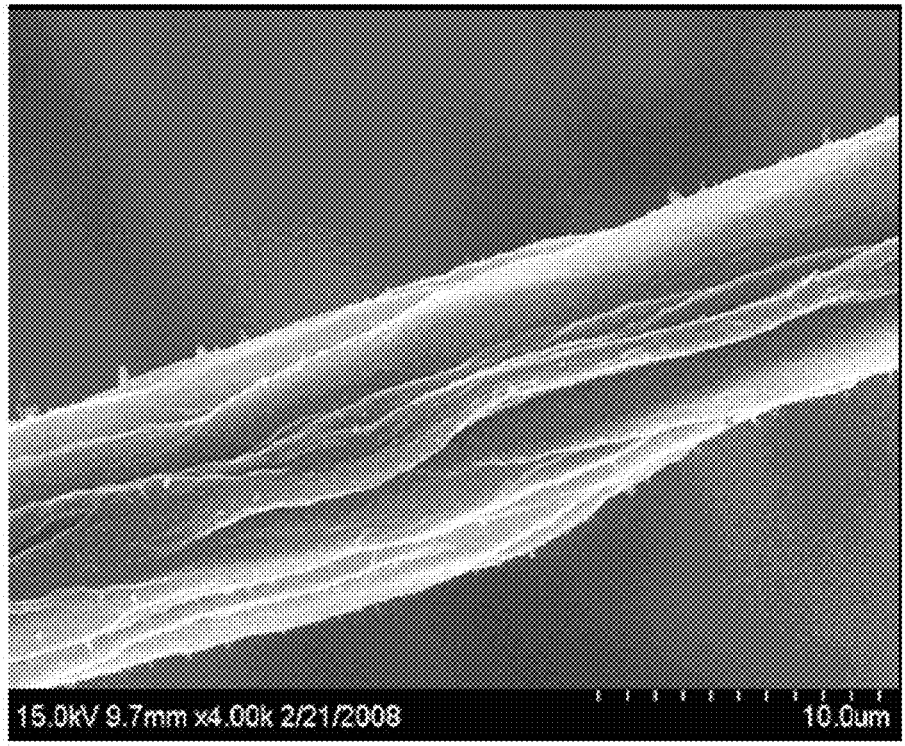
FIG. 7 shows an illustrative embodiment of a microscopic image of a CNT wire.

FIG. 7 shows an illustrative embodiment of a TEM (Transmission Electron Microscopy) image of a CNT wire manufactured from a CNT colloidal solution of SWNT. As can be estimated using the scale displayed at the bottom right portion of the image, the diameter of the CNT wire is about 10 μm. However, the diameter may vary according to the aforementioned parameters such as the withdrawal rate, the concentration of CNT colloidal solution 112 and the like, such that decreased withdrawal rate or increased concentration of CNT colloidal solution 112 will yield a thicker diameter of CNT wire 502. Assuming that the diameter of a single-walled carbon nanotube is about 1 nm, it may be estimated that a portion of CNT wire 502 of about 10 μm includes hundreds of millions of SWNTs. However, the diameter of CNT wire 502 may vary from several micrometers to tens of micrometers depending on the concentration of CNT colloidal collusion 112 and the withdrawing rate of metal tip 120.

Referring again to FIG. 3, in block 340, CNT wire 502 is coated with a polymer 804 (illustrated in FIG. 8, which shows a schematic sectional view of an illustrative embodiment of an enhanced CNT wire 800 coated with polymer 804). At least a part of CNT wire 502 may be coated with polymer 804 to provide protection from external forces and/or damage.

After at least partially coating CNT wire 502 with polymer 804, the entire diameter of enhanced CNT wire 800 may be about 12 μm or less. CNT wire 502 may be entirely coated with polymer 804. In some embodiments, by way of non-limiting example, PDMS may be used as polymer 804. PDMS easily penetrates at least partially into nano-scale gap g between neighboring CNTs 802, as shown in FIG. 8, so that thickness T of PDMS covering CNT wire 502 is generally less than or equal to 1 μm. Therefore, PDMS is a good candidate to enhance the mechanical intensity of CNT wire 502 without losing flexibility or any other beneficial features of CNT wire 502. However, polymer 804, which may be applied to CNT wire 502, is not limited to PDMS and may include other kinds of polymers having high mechanical intensity and flexibility to protect CNT wire 502 from external damage such as polypropylene, polyolefin, polyurethane, etc.

Any of a variety of molding methods may be employed to coat CNT wire 502 with polymer 804. For example, an extrusion molding may be used to apply polymer 804 to CNT wire 502. In extrusion molding, a molten polymer is forced through a shaped orifice by means of pressure so that CNT wire 502 is coated with the molten polymer. Other types of molding methods used to manufacture a conventional electric wire, such as calendar molding, dip molding, etc, may be adopted to coat CNT wire 502 with polymer 804.

Generally, the resistance of an electric wire increases as temperature increases. However, since enhanced CNT wire 800 provides a plurality of routes for electrons to pass through, enhanced CNT wire 800 provides improved conductance despite its relatively small diameter. Further, enhanced CNT wire 800 may have relatively high tensile strength and durability compared to CNT wire 502, which has CNTs 602 that are adhered to neighbor CNTs by relatively weak Van der Waals force. Therefore, enhanced CNT wire 800 disclosed herein may be applicable in various applications including electrical interconnections for micro equipment, micromechanical actuators, power cables, catalyst supports, artificial muscles, micro capacitors, etc.

In light of the present disclosure, those skilled in the art will appreciate that the apparatus and methods described herein may be implemented in hardware, software, firmware, middleware, or combinations thereof, and utilized in systems, subsystems, components, or sub-components thereof. For example, a method implemented in software may include computer code or instructions to perform the operations of the method. This computer code may be stored in a machine-readable medium, such as a processor-readable medium or a computer program product, or transmitted as a computer data signal embodied in a carrier wave, or a signal modulated by a carrier, over a transmission medium or communication link. The machine-readable medium or processor-readable medium may include any medium capable of storing or transferring information in a form readable and executable by a machine (e.g., by a processor, a computer, etc.).

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

For this and other processes and methods disclosed herein, one skilled in the art will appreciate that the functions performed in the processes and methods may be implemented in different order. Further, the outlined operations are only provided as examples. That is, some of the operations may be optional, combined into fewer operations, or expanded into additional operations without detracting from the essence of the disclosed embodiments.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A method for manufacturing an enhanced carbon nanotube (CNT) wire, comprising:

providing a metal tip and a CNT colloidal solution;

forming a CNT wire, wherein forming the CNT wire comprises;

immersing the metal tip at least partially into the CNT colloidal solution; and withdrawing the metal tip from the CNT colloidal solution to form a CNT wire, wherein the CNT wire is formed without applying a voltage between the metal tip and the CNT colloidal solution, and the wire has a length of about 3 cm or more; and directly coating at least a portion of carbon nanotubes in the CNT wire with a polymer.

2. The method of claim 1, wherein the polymer is polydimethylsiloxane (PDMS).

3. The method of claim 2, wherein a thickness of the PDMS is less than or equal to about 1 μm.

4. The method of claim 1, wherein the CNT wire is entirely coated with the polymer.

5. The method of claim 1, wherein the metal tip is made from tungsten (W).

6. The method of claim 1, wherein the immersing further comprises dwelling the metal tip in the CNT colloidal solution for a predetermined time.

7. The method of claim 6, wherein the providing comprises containing the CNT colloidal solution in a vessel, and wherein the withdrawing comprises lowering the vessel substantially vertically.

8. The method of claim 6, wherein the withdrawing comprises lifting the metal tip substantially vertically.

9. The method of claim 6, wherein the withdrawing comprises simultaneously lowering a vessel containing the CNT colloidal solution and lifting the metal tip.

10. The method of claim 1, wherein the providing the CNT colloidal solution comprises dispersing purified CNTs into dimethylformamide (DMF).

11. The method of claim 10, wherein the dispersing comprises dispersing the purified CNTs in the DMF at a concentration of about 0.05 mg/ml.

12. The method of claim 10, wherein the purified CNTs are single-walled carbon nanotubes (SWNTs).

13. The method of claim 6, wherein the withdrawing is performed at room temperature.

14. The method of claim 1, wherein the metal tip is immersed in the CNT colloidal solution for about 2 to about 10 minutes.

15. The method of claim 1, wherein the metal tip is immersed in the CNT colloidal solution for about 4 to about 7 minutes.

16. A method for manufacturing an enhanced carbon nanotube (CNT) wire, comprising:

forming a CNT wire, wherein forming the CNT wire consists of: immersing a metal tip at least partially into the CNT colloidal solution; and withdrawing the metal tip from the CNT colloidal solution, wherein the wire has a length in a range of about 3 cm to about 10 m; and coating at least a portion of the CNT wire with a polymer, wherein the polymer is selected from group consisting of polydimethylsiloxane (PDMS), polypropylene, polyolefin, and polyurethane.

17. The method of claim 1, wherein the polymer is selected from group consisting of polydimethylsiloxane (PDMS), polypropylene, polyolefin, and polyurethane.

18. The method of claim 16, wherein the polymer is polydimethylsiloxane (PDMS).

19. The method of claim 1, wherein the wire has a length in a range of about 3 cm to about 10 cm.

* * * * *

UNITED STATES PATENT AND TRADEMARK OFFICE

CERTIFICATE OF CORRECTION

PATENT NO. : 8,357,346 B2
APPLICATION NO. : 12/195347
DATED : January 22, 2013
INVENTOR(S) : Kim et al.

It is certified that error appears in the above-identified patent and that said Letters Patent is hereby corrected as shown below:

Title Page;
On Title Page 2, in Item (56), under "OTHER PUBLICATIONS", in Column 1, Line 9, delete "18, 1-5." and insert -- vol. 18, pp. 1-5. --, therefor.

On Title Page 2, in Item (56), under "OTHER PUBLICATIONS", in Column 1, Line 12, delete "vol. 17: pp. 3569-3573." and insert -- vol. 17, pp. 3569-3573. --, therefor.

On Title Page 2, in Item (56), under "OTHER PUBLICATIONS", in Column 1, Lines 20-21, delete "19, 427-432 (2007)." and insert -- vol. 19, pp. 427-432 (2007). --, therefor.

On Title Page 2, in Item (56), under "OTHER PUBLICATIONS", in Column 1, Line 23, delete "15, No. 14," and insert -- vol. 15, No. 14, --, therefor.

On Title Page 2, in Item (56), under "OTHER PUBLICATIONS", in Column 1, Line 37, delete "Issue (5):" and insert -- Issue (5), --, therefor.

On Title Page 2, in Item (56), under "OTHER PUBLICATIONS", in Column 2, Line 3, delete "vol. 112:" and insert -- vol. 112, --, therefor.

On Title Page 2, in Item (56), under "OTHER PUBLICATIONS", in Column 2, Line 8, delete "15, No. 16," and insert -- vol. 15, No. 16, --, therefor.

In the Claims;
In Column 6, Line 39, in Claim 1, delete "3 cm or more; and" and insert -- 3 cm to about 10 m; and --, therefor.

In Column 8, Line 13, in Claim 19, delete "10 cm." and insert -- 10 m. --, therefor.

Signed and Sealed this
Sixteenth Day of April, 2013

Teresa Stanek Rea
*Acting Director of the United States Patent and Trademark Office*